United States Patent [19]

Filzen

[11] Patent Number: 4,973,383

[45] Date of Patent: Nov. 27, 1990

[54] BEARING BLANKET FOR AN EXTENDED NIP PRESS

[75] Inventor: Scott E. Filzen, Beloit, Wis.

[73] Assignee: Beloit Corporation, Beloit, Wis.

[21] Appl. No.: 392,639

[22] Filed: Aug. 11, 1989

[51] Int. Cl.[5] ..... D21F 3/02

[52] U.S. Cl. ..... 162/358; 162/361; 428/167; 428/272

[58] Field of Search ..... 162/358, 361, DIG. 1; 428/167, 272, 273

[56] References Cited

U.S. PATENT DOCUMENTS

| | | | |
|---|---|---|---|
| 4,287,021 | 9/1981 | Justus et al. | 162/358 |
| 4,482,430 | 11/1984 | Majaniemi | 162/358 |
| 4,552,620 | 11/1985 | Adams | 162/358 |
| 4,559,258 | 12/1985 | Kiuchi | 162/358 |
| 4,752,519 | 6/1988 | Boyer et al. | 162/358 |

FOREIGN PATENT DOCUMENTS

| | | | |
|---|---|---|---|
| 2106555 | 4/1983 | United Kingdom | 162/358 |

*Primary Examiner*—Karen M. Hastings

*Attorney, Agent, or Firm*—Dirk J. Veneman; Raymond W. Campbell; David J. Archer

[57] ABSTRACT

A bearing blanket is disclosed which extends through an extended nip defined by a shoe and a cooperating backing roll for pressing water from a formed web. The blanket includes a woven-base fabric which defines a web side and a shoe side, and a single liquid impervious urethane layer which is applied to the web side of the base fabric such that the urethane layer thoroughly penetrates into and through the base fabric. The arrangement is such that when the urethane layer is cured, the urethane layer defines a web face and a shoe face. The web face is spaced relative to the web side, with the web face defining a plurality of vents for conveying water pressed from the web away from the extended nip. The shoe face is substantially co-planar with the shoe side of the base fabric such that the shoe face is relatively smooth for cooperating with and moving relative to the shoe.

11 Claims, 1 Drawing Sheet

BEARING BLANKET FOR AN EXTENDED NIP PRESS

BACKGROUND OF THE INVENTION

1. Field of the Invention

This invention relates to a bearing blanket which extends through an extended nip defined by a shoe and a cooperating backing roll for pressing water from a formed web.

More particularly, the present invention relates to a bearing blanket including a woven-base fabric and a liquid impervious urethane layer applied to the base fabric.

2. Information Disclosure Statement

Bearing blankets are used for pressing water from a formed web during passage of the web through an extended nip press.

An extended nip press includes a press shoe and a cooperating backing roll for defining therebetween an extended nip. The press shoe defines a concave surface which cooperates with the outer surface of the backing roll such that when an endless looped bearing blanket extends through the extended nip, the bearing blanket is permitted to move with a web supported thereon through the extended nip. The interface between the bearing blanket and the shoe is lubricated to permit relative movement therebetween and the blanket together with one or more felts supports the web during transit of the web through the extended nip.

In the prior art, bearing blankets have been typically manufactured by training a base fabric around spaced rollers and applying a first coating of urethane to one side of the base fabric.

The urethane coating is then cured and optionally grooved. The base fabric with the first coating is subsequently turned inside out so that the other side of the base fabric can be coated.

Not only is the aforementioned manufacturing process relatively time consuming and complex, but more particularly, such prior art proposals have resulted in a bearing blanket having two urethane layers thereon with the attendant thickness thereof.

Such undue thickness and the provision of two such layers has resulted in the delamination of the urethane layers under extended usage of the bearing blanket.

Additionally, reversing of the bearing blanket in order to coat the opposite side of the base fabric has proved cumbersome. Problems have been experienced when manufacturing a bearing blanket suitable for use in the so-called apple type ENP disclosed in U.S. Pat. No. RE31,923 to Justus. A blanket of the aforementioned type typically has a circumference of 13 feet and a width of up to 35 feet. Turning such a blanket inside out without damaging the urethane layer applied thereon has proved to be difficult.

The present invention overcomes the aforementioned inadequacies of the prior art proposals by applying a single layer of urethane to a base fabric such that the urethane penetrates into and through the base fabric to provide a smooth shoe contacting face and a subsequently grooved web face.

Such single layered bearing blanket has a thickness which is substantially less than the thickness of the double layered prior art proposals and does not require the reversing step during manufacture thereof.

Therefore, it is the primary object of the present invention to provide a bearing blanket that overcomes the aforementioned inadequacies of the prior art proposal and which makes a significant contribution of the art of extended nip pressing.

Another object of the present invention is the provision of a bearing blanket having a single urethane layer so that the thickness of the blanket is minimized thereby inhibiting delamination of the resultant blanket.

Another object of the present invention is the provision of a bearing blanket in which a single layer of urethane is applied to a base fabric such that reversing of the blanket during manufacture thereof is avoided.

Another object of the present invention is the provision of a bearing blanket in which the web face is provided with a plurality of parallel-spaced grooves with grooves adjacent to the lateral edges of the blanket being ground-off in order to relieve the stresses applied to the blanket during multi-plane bending of the blanket while extending through an extended nip.

Other objects and advantages of the present invention will be apparent to those skilled in the art by consideration of the detailed description contained hereinafter taken in conjunction with the annexed drawings.

SUMMARY OF THE INVENTION

The present invention relates to a bearing blanket and a method of manufacturing the same, the blanket extending through an extended nip defined by a shoe and a cooperating backing roll for pressing water from a formed web. The blanket includes a woven-base fabric which defines a web side and a shoe side.

Additionally, the blanket includes a single liquid impervious urethane layer which is applied to the web side of the base fabric such that the urethane layer thoroughly penetrates into and through the base fabric so that when the urethane layer is cured, the urethane layer defines a web face and a shoe face.

The web face is spaced relative to the web side and the web face defines a plurality of venting means for conveying water pressed from the web away from the extended nip. The shoe face is substantially co-planar with the shoe side of the base fabric such that the shoe face is relatively smooth for cooperating with and moving relative to the shoe.

In a more specific embodiment of the present invention, the base fabric is manufactured from nylon filaments, and the urethane layer has a hardness within the range 85–100 on the Shore A hardness scale.

The plurality of venting means include in a preferred embodiment to the present invention a plurality of parallel-spaced grooves with the grooves extending in a machine direction.

In an alternative embodiment of the present invention, the parallel grooves extend diagonally relative to a machine direction.

Each groove of the plurality of grooves has a depth within the range 0.05 to 0.2 inches and has a width within the range 0.02 to 0.04 inches. Furthermore, the grooves are spaced relative to each other within the range 6 to 10 grooves per inch.

In a preferred embodiment of the present invention, the grooves which are disposed adjacent to each lateral edge of the bearing blanket are ground off such that stress applied to the blanket during multi-plane bending of the blanket while extending through the extended nip is reduced.

In another embodiment of the present invention, the plurality of venting means includes a plurality of spaced blind drilled holes for the reception therein of water pressed from the web.

The present invention also includes a method of manufacturing a bearing blanket which includes the steps of wrapping a base fabric around a smooth cylindrical mandrel and pressure applying a urethane layer onto and through the base fabric such that the shoe face of the single urethane layer is relatively smooth and coplanar with a shoe side of the base fabric while a web face of the single layer is spaced relative to a web side of the base fabric.

Many modifications and variations of the present invention will be readily apparent to those skilled in the art by a consideration of the detailed description of the preferred embodiment taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
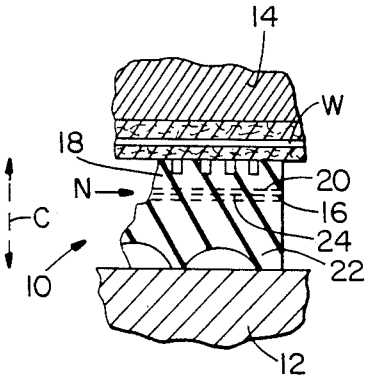
FIG. 1 PRIOR ART
FIG. 1 is a sectional view through a prior art bearing blanket having a base fabric with a web side layer and a shoe side layer applied thereon.

FIG. 1 is a sectional view of a typical prior art bearing blanket generally designated 10 for extending through an extended nip N defined between a shoe 12 and a cooperating backing roll 14 for pressing water from a formed web W.

The prior art bearing blanket 10 includes a woven base fabric 16 and a first urethane layer 18 applied to the web side 20 of the base fabric 16.

A second urethane layer 22 is applied to the shoe side 24 of the base fabric 16.

The resultant prior art bearing blanket 16 has an overall caliper C which is relatively thick resulting in premature delamination and break-down of the resultant blanket 10.

Figure 2:
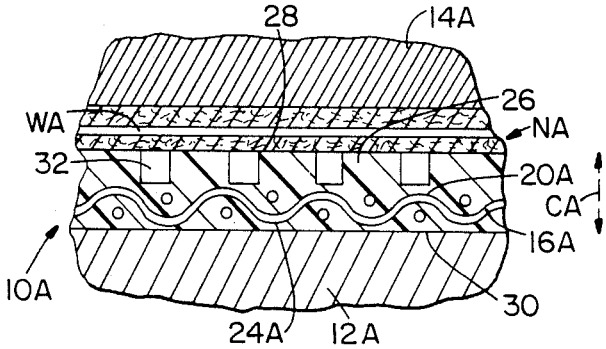
FIG. 2 is a sectional view of a bearing blanket according to the present invention showing a base fabric and a single urethane layer applied thereto.

FIG. 2 is a sectional view of a bearing blanket generally designated 10A according to the present invention. The blanket 10A extends through an extended nip NA defined by a shoe 12A and a cooperating backing roll 14A for pressing water from a formed web WA.

The blanket 10A includes a woven based fabric 16A defining a web side 20A and a shoe side 24A.

A single liquid impervious urethane layer 26 is applied to the web side 20A of the base fabric 16A such that the urethane layer 26 thoroughly penetrates into and through the base fabric 16A so that when the urethane layer 26 is cured, the urethane layer 26 defines a web face 28 and a shoe face 30.

The web face 28 is spaced relative to the web side 20A. The web face 28 defines a plurality of venting means generally designated 32 for conveying water pressed from the web WA away from the extended nip NA.

The shoe face 30 of the layer 26 is substantially coplanar with the shoe side 24A of the base fabric 16A such that the shoe face 30 is relatively smooth for cooperating with and moving relative to the shoe 12A.

The base fabric 16A, as shown in FIG. 2, is manufactured from nylon monofilaments and the urethane layer 26 has a hardness within the range 85 to 100 on the Shore A hardness scale.

Figure 3:
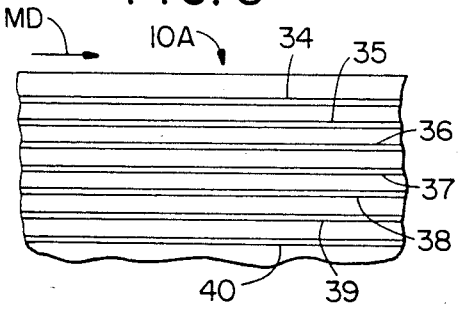
FIG. 3 is a plan view of the blanket shown in FIG. 2.

FIG. 3 is a plan view of the blanket 10A shown in FIG. 2 and shows a plurality of parallel spaced grooves 34,35,36,37,38,39,40 with the grooves 34 to 40 extending in a machine direction as indicated by the arrow MD.

Figure 4:
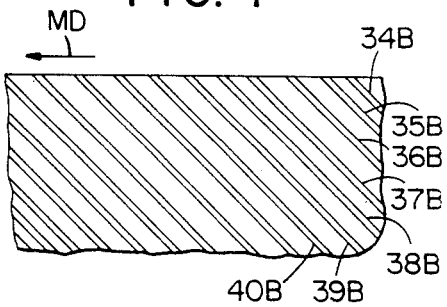
FIG. 4 is a plan view of an alternative embodiment of the present invention showing diagonal grooves.

In an alternative embodiment of the present invention as shown in FIG. 4, the grooves 34B,35B,36B,37B,38B,39B,40B extend diagonally relative to the machine direction as indicated by the arrow MD.

In both the embodiments of FIGS. 3 and 4, each groove of the plurality of grooves has a depth within the range 0.05 to 0.2 inches.

Furthermore, each groove of the plurality of grooves has a width within the range 0.02 to 0.04 inches and preferably a width of 0.031 inches.

Additionally, the grooves are spaced relative to each other within the range 6 to 10 grooves per inch and in a preferred embodiment have a spacing of 8 grooves per inch.

Figure 5:
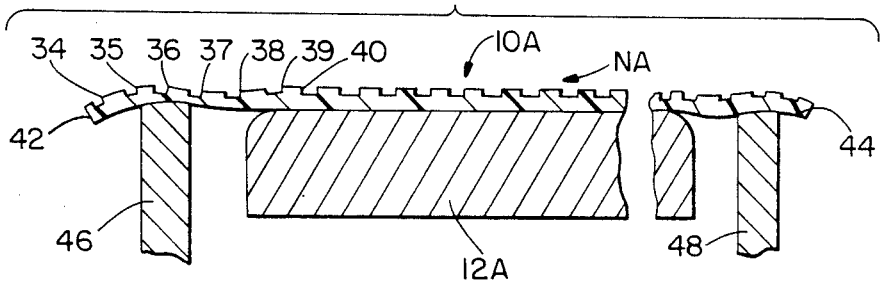
FIG. 5 is a fragmentary sectional view showing the lateral edges of the blanket shown in FIG. 2.

As shown in FIG. 5, the plurality of parallel spaced grooves 34 to 40 include grooves 34–39 which are disposed adjacent to lateral edges 42 and 44 of the blanket 10A. Such grooves 34–39 are ground off as shown in FIG. 5 such that stress applied to the blanket 10A during multi-plane bending of the blanket 10A while extending through the extended nip NA and over the lateral rotatable heads 46 and 48 is reduced.

The present invention provides a bearing blanket which is easy to manufacture and which avoids the complex process step of reversing the blanket during manufacture and more importantly provides a bearing blanket having a caliper, or thickness, CA which is considerably less than the thickness C of the counterpart prior art two layered blankets, thereby inhibiting delamination and early failure of the resultant bearing blanket.

What is claimed is:

1. A bearing blanket extending through an extended nip defined by a shoe and cooperating backing roll for pressing water from a formed web, said blanket comprising:

a woven-base fabric defining a web side and a shoe side;

a single liquid impervious urethane layer applied to said web side of said base fabric such that said urethane layer thoroughly penetrates into and through said base fabric so that when said urethane layer is cured, said urethane layer defines a web face and a shoe face;

said web face being spaced relative to said web side, said web face defining a plurality of venting means for conveying water pressed from the web away from the extended nip; and said shoe face being substantially co-planar with said shoe side of said base fabric such that said shoe face is relatively smooth for cooperating with and moving relative to the shoe.

2. A bearing blanket as set forth in claim 1 wherein said base fabric is manufactured from nylon monofilaments.

3. A bearing blanket as set forth in claim 1 wherein. said urethane layer has a hardness within the range 85 to 100 on the Shore A hardness scale.

4. A bearing blanket as set forth in claim 1 wherein said plurality of venting means includes:

a plurality of parallel spaced grooves.

5. A bearing blanket as set forth in claim 4 wherein said grooves extend in a machine direction.

6. A bearing blanket as set forth in claim 4 wherein said grooves extend diagonally relative to a machine direction.

7. A bearing blanket as set forth in claim 4 wherein each groove of said plurality of grooves has a depth within the range 0.05 to 0.2 inches.

8. A bearing blanket as set forth in claim 4 wherein each groove of said plurality of grooves has a width within the range 0.02 to 0.04 inches.

9. A bearing blanket as set forth in claim 4 wherein said grooves are spaced relative to each other within the range 6 to 10 grooves per inch.

10. A bearing blanket as set forth in claim 5 wherein grooves of said plurality of parallel-spaced grooves disposed adjacent to each lateral edge of the bearing blanket are ground-off such that stress applied to the blanket during multi-plane bending of the blanket while extending through the extended nip is reduced.

11. A bearing blanket as set forth in claim 1 wherein said plurality of venting means includes:

a plurality of spaced blind drilled holes for the reception therein of water pressed from the web.

* * * * *